United States Patent [19]

Ohta et al.

[11] Patent Number: 4,482,880

[45] Date of Patent: Nov. 13, 1984

[54] IRON CORE FOR THREE-PHASE ELECTROMAGNETIC INDUCTION MACHINE

[75] Inventors: Yoshihiro Ohta, Kawanishi; Hidenori Kawakami, Amagasaki; Keiji Tsuruta, Takarazuka, all of Japan

[73] Assignee: Mitsubishi Denki Kabushiki Kaisha, Tokyo, Japan

[21] Appl. No.: 414,028

[22] Filed: Sep. 2, 1982

[30] Foreign Application Priority Data

Sep. 10, 1981 [JP] Japan ..... 56/143590

[51] Int. Cl.[3] ..... H01F 27/24

[52] U.S. Cl. ..... 336/217; 336/216; 336/234

[58] Field of Search ..... 336/216, 217, 234

[56] References Cited

U.S. PATENT DOCUMENTS 3,477,053 11/1969 Burkhardt et al. .
3,559,136 1/1971 Specht et al. .
3,569,886 3/1971 Specht .
3,611,234 10/1971 Delaurentis et al. ..... 336/217
3,918,153 11/1975 Burkhardt et al. ..... 336/217 X

FOREIGN PATENT DOCUMENTS 764093 7/1967 Canada ..... 336/217
28570 1/1972 Japan .
22607 4/1974 Japan .
42284 9/1974 Japan .

*Primary Examiner*—A. D. Pellinen
*Assistant Examiner*—S. Steward
*Attorney, Agent, or Firm*—Wenderoth, Lind & Ponack

[57] ABSTRACT

An iron core including two outer legs and a central leg connected at each end to a different one of the outer legs through a yoke. Each of the outer legs includes a stack of trapezoid laminations connected to a stack of trapezoid laminations of the yoke alternating its trapezium laminations through angle butt joints arranged stepwise with equal incremental intervals, the yoke laminations being longer than one another by equal increments equal to that intervals. The central leg includes a stack of parallelogramic laminations alternating those inverted widthwise from the same and connected in lapped relationships to the yoke laminations.

2 Claims, 12 Drawing Figures

FIG. 1
PRIOR ART
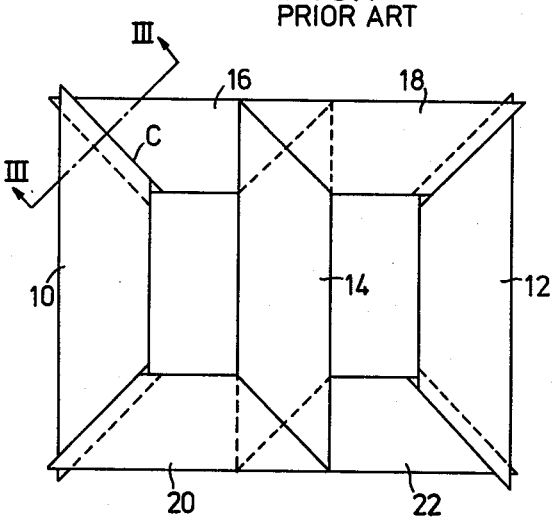
FIG. 3
PRIOR ART
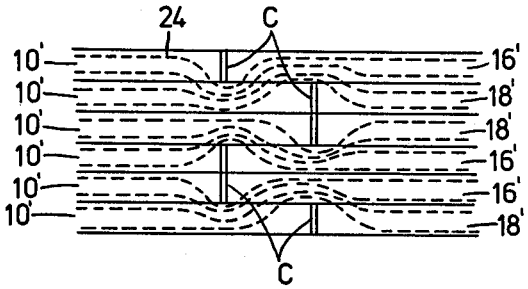
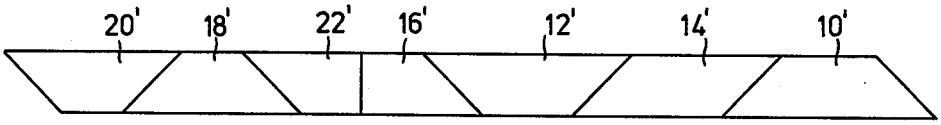
FIG. 2
PRIOR ART
FIG. 4
PRIOR ART
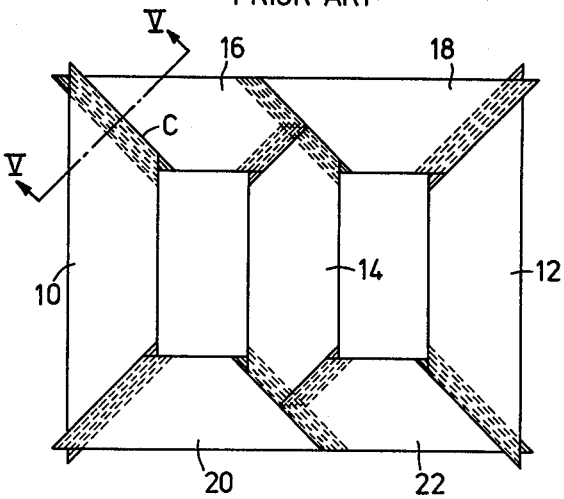
FIG. 5
PRIOR ART
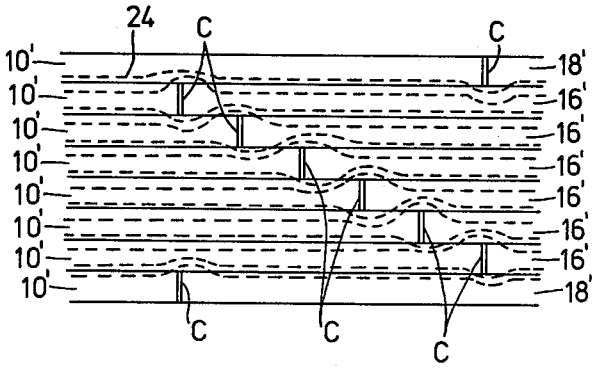

IRON CORE FOR THREE-PHASE ELECTROMAGNETIC INDUCTION MACHINE

BACKGROUND OF THE INVENTION

This invention relates to an iron core for a three-phase electromagnetic induction machine.

The saving of energy and resources has been recently advocated resulting in improvements in iron cores for a three-phase electromagnetic induction machine. A conventional iron core of the type referred to has comprised a pair of outer legs, a central leg, a pair of first yokes for connecting one end of the central leg to corresponding ends of the outer legs and a pair of second yokes for connecting the other end of the central leg to corresponding ends of the outer legs. In order to manufacture such an iron core, electrical steel sheets have been cut into strips extending in the rolled direction thereof and having a width equal to the common width of the legs and yokes. Each of the strips has been cut into laminations having respective shapes specified to the legs and yokes. Thus, each of the laminations has a magnetization direction coinciding with the longitudinal axis thereof. The laminations have been stacked on one another and abutted against associated ones of the laminations to form the legs and yokes interconnected as described above. At that time, the connection of the outer leg to each of the first and second yokes has included the stacked laminations of the outer leg connected to those of the first or second yoke through angle butt joints and also lapped in alternating manner on the laminations of the first yokes adjacent thereto. These laminations have been cut from the electrical steel sheets without any scrap but a magnetic flux flowing through each lamination has been locally concentrated on that portion of the overlaid or underlaid lamination located at the mating joint resulting in an increase in iron core loss.

In order to reduce this increase in iron core loss, another iron core for a three-phase electromagnetic induction machine has been proposed. The proposed iron core has been different from the first mentioned iron core in the manner in which the laminations of the outer leg are connected to those of each of the first and second yokes and the shape of the laminations forming the central leg. More specifically, the laminations of the outer leg have been connected to those of the first or second yoke through angle butt joints arranged in stepped manner with equal incremental intervals. Thus, the local concentration of the magnetic flux has been alleviated. However, since the central leg has been formed of a stack of hexagonal laminations, scraps have occurred upon cutting strips of electrical steel sheets into laminations. This is because the laminations of the central leg change their shape from the parallelogram in the firstmentioned iron core to the hexagon in the proposed iron core and the laminations forming the yokes change in shape accordingly. Further a waveform of a magnetic flux flowing through each of the outer legs has been much distorted as compared with the first mentioned iron core including the central leg formed of a stack of parallelogramic laminations.

Accordingly, it is an object of the present invention to provide a new and improved iron core for a three-phase electromagnetic induction machine reduced in iron core loss and formed of stacked laminations cut from an electrical sheet without any scrap.

SUMMARY OF THE INVENTION

The present invention provides an iron core for a three-phase electromagnetic induction machine comprising a plurality of legs connected to a plurality of yokes, each of the legs and yokes being formed of a stack of a predetermined number of core laminations specified thereto, the arrangement being so that the connection of a central one of the legs to an associated one of the yokes includes a stack of the laminations in the form of parallelograms alternating the laminations inverted widthwise from the same and that the connection of an outer one of the legs to an associated one of the yokes includes the stacked leg laminations connected to associated ones of the stacked yoke laminations through angle butt joints arranged stepwise with predetermined equal incremental intervals, the yoke laminations being longer than one incremental intervals.

BRIEF DESCRIPTION OF THE DRAWINGS

The present invention will become more readily apparent from the following detailed description taken in conjunction with the accompanying drawings in which:

FIG. 1 is a plan view of a conventional iron core for a three-phase electromagnetic induction machine;

FIG. 2 is a view of a pattern in which an electrical steel sheet is cut into core laminations forming the iron core shown in FIG. 1;

FIG. 3 is a sectional view in an enlarged scale of the arrangement shown in FIG. 1 with the section taken along the line III—III of FIG. 1;

FIG. 4 is a plan view of another conventional iron core for a three-phase electromagnetic machine;

FIG. 5 is a sectional view in an enlarged scale arrangement shown in FIG. 4 with the section taken along the line V—V of FIG. 5;

DESCRIPTION OF THE PREFERRED EMBODIMENTS

Figure 6:
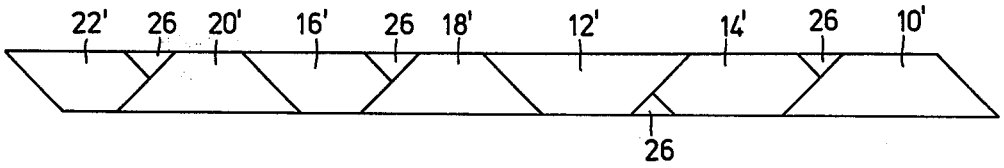
FIG.6 PRIOR ART
FIG. 6 is a view similar to FIG. 2 but illustrating the arrangement shown in FIG. 4.

Referring now to FIG. 1 of the drawings, there is illustrated a conventional iron core for a three-phase electromagnetic induction machine, for example, a three-phase transformer. The arrangement illustrated comprises a pair of outer legs 10 and 12, a central leg 14, a pair of first yokes 16 and 18 or upper yokes as viewed in FIG. 1 and a pair of second yokes 20 and 22 or lower yokes as viewed in FIG. 1. Those legs and yokes are formed from an electrical sheet and formed by cutting the electrical steel sheet into laminations forming four sides of a picture frame so as to cause the magnetization direction of the legs and yokes to coincide with a rolled direction of the electrical steel sheet and also to permit a magnetic flux to easily pass through the connection of each leg to an associated one of the yokes and stacking the laminations on one another. In FIG. 1 solid line designates the laminations disposed on the upper layer and dotted line designates those portions of the laminations disposed on other layers and different from the corresponding portions of the lamination on the upper layer.

FIG. 2 illustrates, by way of example, a pattern in which an electrical steel sheet is cut into laminations forming the legs and yokes of the iron core shown in FIG. 1. The electrical steel sheet (not shown) is first cut in a rolled direction thereof into strips having a width equal to the common width of the legs and yokes. Then each of strips is successively cut into laminations 10', 14', 12', 16', 22', 18' and 20' in the named order as shown in FIG. 2. The laminations are designated by the reference numerals identifying the components of the iron core as shown in FIG. 1 formed of the same with a prime. For example, the reference numeral 10' designates the lamination forming the outer leg 10. Those laminations are disposed at their positions corresponding to the legs and yokes shown in FIG. 1 a predetermined number (which may be of one) of the laminations for each of the legs and yoke. More specifically predetermined numbers of the laminations 10', 12' and 14' are stacked on one another at the positions of the outer and central legs 10, 12 and 14, respectively, the predetermined numbers of the laminations 16' and 18' are stacked in alternating relationship on one another at the positions of the upper yokes 16 and 18 and the predetermined numbers of the laminations 20' and 22' are stacked in alternating relationship on one another of the positions of the lower yokes 20 and 22. In this way one set of the predetermined number of the stacked laminations is formed for each of the legs and yokes. Then a plurality of such sets are superposed on one another to form each of the legs and yokes.

From FIG. 2 it is seen that the electrical steel sheet can be cut into the laminations without any scrap developed upon the cutting thereof. However, the resulting iron core has been disadvantageous in that the iron core loss is increased for the following reasons: The connection of the outer leg 10 to the upper yoke 16 includes, as one set, the stacked laminations of the outer leg 10 connected to associated ones of the stacked laminations of the upper yoke 16 through respective angle butt joints so that pairs of superposed leg laminations lapped on the adjacent yoke laminations alternate pairs of superposed leg laminations not lapped on the adjacent yoke laminations.

Referring to FIG. 3, there is illustrated the section of the arrangement of FIG. 1 taken along the line III—III of FIG. 1 assuming that each of the outer leg 10 and the upper leg 16 includes, as one set, a stack of the six stacked laminations. In FIG. 3, the connection of the outer leg 10 to the upper yoke 16 includes a first layer formed of the leg lamination 10' connected to the yoke lamination 16' through an angle butt joint C, a second and a third layer formed of the two superposed laminations 10' connected to the two stacked laminations 16' and 18' through a pair of angle butt joints C vertically aligned with each other and displaced from the angle butt joint C on the first layer, a fourth and a fifth layer formed of two superposed laminations 10' connected to the two superposed laminations 16' through respective angle butt joints C vertically aligned with each other and with the angle butt joint C on the first layer, and a sixth layer formed of the leg lamination 10' connected to the yoke lamination 18' through an angle butt joint C vertically aligned with the angle butt joints on the second and third layers. Thus the leg laminations 10' on the second and third layers are put in lapped relationship with the yoke laminations 16' on the first and fourth layers. Also the lamination 10' on the sixth layer is lapped on the lamination 16' on the fifth layer. However the two superposed by laminations 10' on the fourth and fifth layers interposed between the third and sixth layers are not put in lapped relationship with any yoke lamination. This is true in the case of the lamination 10' on the first layer.

The foregoing is also applied to the connection of the outer leg 12 to the lower yoke 22 and other connections of legs 10 and 12 to the yokes 16, 18, 20 and 22.

Thus, a magnetic flux flowing through the connection of the leg 10 to the yoke 16 is locally concentrated on those portions of the laminations adjacent to the angle butt joints C as shown by a distribution of magnetic flux 24 in FIG. 3. This has resulted in an increase in iron core loss.

In order to substantially eliminate or minimize this local concentration of the magnetic flux, an iron core for a three-phase electromagnetic induction machine as shown in FIG. 4 has been proposed and put to practical use. The arrangement illustrated is different from that shown in FIGS. 1 and 3 only in that in FIG. 4 wherein like reference numerals designate components identical or corresponding to those shown in FIG. 1, each of the connections of the outer legs to associated yokes includes the leg laminations connection to associated yoke laminations in a manner different from that shown in FIG. 3 and that the laminations forming the central leg are different in shape from those shown in FIG. 1. In FIG. 5 wherein like reference numerals designate components identical or corresponding to those shown in FIG. 3, eight layers are superposed on one another each of which includes a leg lamination 10' connected to an associated yoke lamination 16' or 18' through an angle butt joint C. More specifically, the leg laminations 10' on the second through seventh layers are connected to the associated yoke laminations 16' through respective angle butt joints C arranged stepwise with predetermined equal incremental intervals and the leg laminations 10' on the first and eighth layers are connected to the associated yoke laminations 18' through respective corresponding angle butt joints C. The angle butt joint C on the first layer is vertically aligned with that on the seventh layer and the angle butt joint C on the eight layer is vertically aligned with that on the second layer. This is true in the case of the remaining connections of the legs to the yokes shown in FIG. 4.

FIG. 5 shows also a distribution of magnetic flux 24 flowing through the connection of the outer leg 10 and the upper yoke 16. The distribution of the magnetic flux 24 depicts the alleviation of the local concentration of the magnetic flux adjacent to the angle butt joints C. This results in a reduction of iron core loss developed adjacent to each of the joints C.

However, since the laminations 14' forming the central leg 14 are hexagonal, it is required to cut the lamination 14' from a strip of an electrical steel sheet according to a pattern as shown in FIG. 6 wherein like reference numerals designate the components identical or corresponding to those shown in FIG. 2. As shown in FIG. 6, scraps 26 are cut off from the opposite corner of the lamination 14' and one corner of the laminations 16' and 22'. This has resulted in poor economy.

Figure 7:
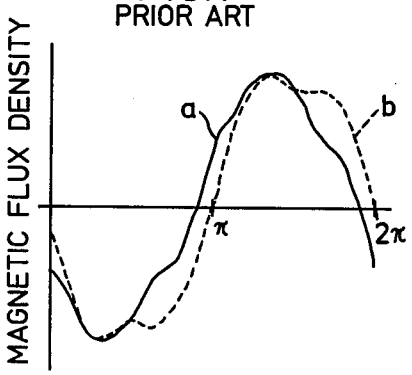
FIG.7 PRIOR ART
FIG. 7 is a graph illustrating waveforms of magnetic flux flowing through the respective outer legs shown in FIGS. 1 and 4.

Also, the arrangement of FIG. 4 has been disadvantageous in that the waveform of magnetic flux flowing in each of the outer legs 10 and 20 are much distorted as compared with the arrangement of FIG. 1 which as the central leg formed of the laminations 14' in the form of parallelograms, as shown in FIG. 7.

In FIG. 7, magnetic flux density is measured along the ordinate and one cycle of the magnetic flux flowing through one leg of the arrangements shown in FIGS. 1 and 4 is measured along the abscissa. A solid curve a shows the waveform of magnetic flux flowing through each of the outer legs 10 and 12 shown in FIG. 1 and a dotted curve b depicts the same for each of the outer legs 10 and 12 shown in FIG. 4. The curve a substantially closely resembles a sinusoidal curve whereas the curve b nearly has the shape of an upright and an inverted trapezoid. From FIG. 7 it is seen that the waveform of the magnetic flux expressed by the curve b has a large distortion. This attributed to an inflow of the magnetic flux into one outer leg when that one outer leg is not excited. The arrangement of FIG. 4 is larger in this tendency than that shown in FIG. 1. When an iron core for a three-phase electromagnetic induction machine is formed of laminations cut from electrical steel sheet having a high ratio of eddy current loss to total iron core loss, the arrangement of FIG. 4 has been disadvantageous in that, even though the angle butts joints C have been improved to reduce the increase in iron core loss developed at each of those joints, such an adverse reaction results in an increase in iron core losses at positions other than the angle butt joints to an extent exceeding the above mentioned reduction of the increase in iron core loss. This disadvantage is large particularly with high magnetic induction oriented silicon steel sheets used to manufacture the iron core such as shown in FIG. 4.

The present invention contemplates to eliminate the disadvantages of the prior art practice as described above by the provision of an iron core for a three-phase electromagnetic induction machine decrease in iron core loss and formed of core laminations cut from an electrical steel sheet without any scrap and with reduced costs.

Figure 8:
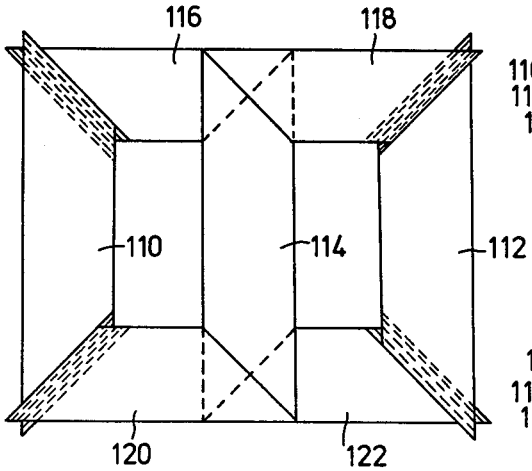
FIG. 8 is a plan view of one embodiment of according to the iron core of the present invention for a three-phase electromagnetic induction machinery.

Referring now to FIG. 8, there is illustrated one embodiment of the iron core according to the invention for a three-phase electromagnetic induction machine such as a three-phase transformer. The arrangement illustrated comprises a pair of outer legs 110 and 112, a central leg 114, a pair of first yokes 116 and 118 shown in FIG. 8 as being upper yokes and a pair of second yokes 120 and 122 shown in FIG. 8 as being lower yokes as in the arrangements shown in FIGS. 1 and 4. Each of the legs and yokes includes a stack of a predetermined number of laminations cut from electrical steel sheets. By utilizing the method of cutting laminations as shown in FIG. 2, the respective lamination of the legs and yokes are cut from electrical steel strips. More specifically, the laminations of the outer leg 110, the central leg 114 and the outer leg 114 are successively cut from strips of the electrical steel sheets to be identical to the lamination 10', 14' and 12' respectively, that is to say, to be of a trapezoid, a parallelogram and an inverted trapezoid, respectively. Then the laminations of the yokes 116, 122, 118 and 120, are successively cut from the strips to be similar to the laminations 16', 22' 18' and 20' shown in FIG. 2, that is to say, to be of a trapezoid having one side edge perpendicular to the parallel top and bottom edges and therefore two right angles (a "right angle trapezoid"), its inversion, a trapezoid having two oblique side edges and therefore no right angles (a "non-right angle trapezoid") and its inversion, respectively, except that a predetermined number of each of those laminations are successively longer than one another with predetermined equal increments for each of the yokes, for the purpose as will become apparent below.

In order to connect the outer leg 110 to the upper yoke 116, the laminations of a predetermined number forming the outer leg 110 are stacked on one another so that those laminations are connected to associated ones of the laminations forming the upper yoke 116 through angle butt joints arranged stepwise with equal incremental intervals equal to the predetermined equal increments for the yoke laminations. In other words, the leg laminations are stacked on one another and connected to the associated yoke laminations, so that the stacked leg laminations abut the associated stacked yoke lamination in stepwise displaced relationship.

Figure 9:
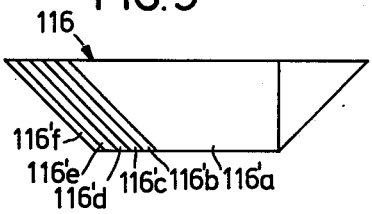
FIG. 9 is a plan view illustrating the manner in which laminations of the yoke shown in FIG. 8 are stacked on one another.
Figure 10:
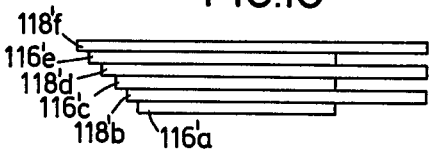
FIG. 10 is a side elevational view of the stack of the yoke laminations shown in FIG. 9.

The stack of laminations forming the upper yoke 116 includes the laminations similar to the laminations 16' (see FIG. 2) and alternating those similar to the laminations 18' (see FIG. 2) as shown in FIGS. 9 and 10.

FIGS. 9 and 10 show a stack of six laminations forming the upper yoke 116 as viewed from the upper and lateral surface thereof respectively. In FIG. 10 a first one 116'*a* of those laminations is shown as being disposed on the lowermost layer. The first lamination 116'*a* is identical in shape to the lamination 16' (see FIG. 2) having one side perpendicular to the rolled direction of the electrical steel sheet and has disposed thereon a second lamination 118'*b* similar in shape to the lamination 18' having both sides oblique to the rolled direction and longer than the first lamination 116'*a* by a length equal to the predetermined equal increments as described above. A third lamination 116'*c* is disposed on the second lamination 118'*b* and similar to the first lamination 116'*a* but it is longer than the second lamination 118'*a* by a length equal to the equal increments. A fourth lamination 118'*d* disposed on the third lamination 116'*c* is similar in shape to the second lamination 118'*b* but longer than the third lamination 116'*c* by a length equal to the equal increments. The fourth lamination 118'*d* has disposed thereon a fifth lamination 116'*e* similar in shape to the third lamination 116'*c* but longer than the same by a length equal to the equal increments. Finally a sixth lamination 118'*f* is disposed on the fifth lamination 116'*e*. The sixth lamination 118'*f* is similar in shape to the second lamination 118'*b* but longer than the fifth lamination 116'*e* by a length equal to the equal increments.

From the foregoing it is seen that the upper yoke 116 includes the six laminations stacked on one another to be stepwise desplaced from one another by equal incremental lengths.

The upper yoke 116 is formed of a plurality of sets each including the six laminations stacked as described above and superposed on one another while the outer leg 110 is also formed of a plurality of sets each including the six laminations connected to those of the upper yoke 116 as described above and superppsed on one another.

The foregoing is also applied to connections of the outer leg 110 to the lower yoke 120 and of the outer leg 112 to each of the upper and lower yokes 118 and 122, respectively.

Figure 11:
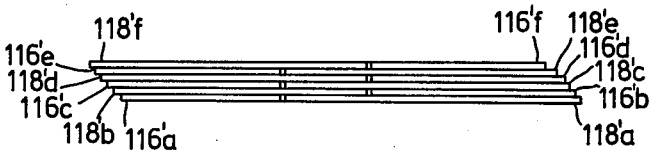
FIG. 11 is a side elevational view of the arrangement shown in the FIGS. 8, 9 and 10 as viewed from the side of the yoke thereof.

FIG. 11 shows the upper yoke 116 including the six laminations thus stacked with the upper yoke 118 including six laminations stacked on one another to be connected to associated ones of the laminations of the upper yoke 116 through respective butt joints, as viewed on the upper lateral surface thereof.

As shown in FIG. 11, the first lamination 116'*a* of the yoke 116 is connected to a first lamination 118'*a* of the yoke 118 having the longest length through a butt joint and the second lamination 118'*b* of the yoke 116 is connected to a second lamination 116'*b* of the yoke 118 having the longest length through a butt joint displaced from the first mentioned butt joint by a predetermined distance. In this way the laminations of the yoke 116 are connected to associated ones of the lamination of the yoke 118 to have the total lengths remaining unchanged until the sixth lamination of the yoke 116 is connected to that of the yoke 118 having the shortest length.

The stacked laminations of the yokes 116 and 118 are connected to associated ones of stacked laminations of the central leg 114 through angle butt joints, respectively. The central leg 14 includes the parallelogramic laminations stacked on one another and alternating the laminations inverted widthwise from the same while the parallelogramic laminations are connected in lapped relationships to the associated laminations of the upper yokes 116 and 118. This is applied to the connection of the central leg 114 and the lower yokes 120 and 122.

Figure 12:
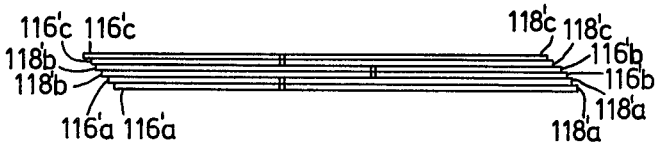
FIG. 12 is a view similar to FIG. 11 but illustrating a modification of the present invention for a three-phase electromagnetic induction machine.

In a modification of the present invention shown in FIG. 12, the single yoke lamination as shown in FIG. 11 is respectively, by a double yoke lamination similar to that shown in FIG. 3 each pair of yoke laminations similar in shape to each other but different from each other by a length equal to the predetermined equal increments as described above. In other respects the arrangement illustrated is identical to that shown in FIG. 11. If desired, each of yoke laminations as shown in FIG. 11 may be replaced by a predetermined number of yoke laminations similar in shape to one another but different from one another by the predetermined equal increments.

From the foregoing it is seen that on each of the connections of each of the outer legs 110 or 112 to the associated yokes 116, 118, 120 and 122 magnetic flux can be smoothly transferred from one to the other of the leg and yoke resulting in a reduction in an increase in iron core loss developed on each of the connections. Also since the central leg 114 is connected in lapped relationship to each of the upper and lower yokes 116, 118, 120 or 122, electrical steel strips can be not only cut into laminations of the legs and yokes without any scrap as described above in conjunction with FIGS. 1 and 2 but also each of the outer legs 110 and 112 has flowing through a magnetic flux whose waveform is less distorted. Therefore, even where core laminations are cut from a high single-oriented electrical steel sheet such as a high magnetic induction oriented silicon steel sheet, a destruction factor of an iron loss can be increased.

From the foregoing it is seen that the present invention provides an iron core for a three-phase electromagnetic induction machine in which each of the outer legs is connected in stepped manner to an associated one of the yokes and a center leg connected to the yokes in a lapped manner such that the overlapping diagonal edges has the appearance of an X. Thus, the resulting iron core is low in iron core loss and can be inexpensively manufactured because electrical steel strips can be cut in core laminations without any scrap.

The iron core of the present invention is particularly suitable for use with three-phase transformers.

While the present invention has been illustrated and described in conjunction with a few preferred embodiments thereof, it is to be understood that numerous changes and modifications may be resorted to without departing from the spirit and scope of the present invention.

What is claimed is:

1. An iron core for a three-phase electromagnetic induction machine comprising:

a plurality of legs including a central leg and outer legs; and a plurality of yokes connecting said outer legs to said central leg;

each of said legs and yokes being formed of a corresponding stack of a predetermined number of core laminations specific thereto;

said central leg including a stack of said laminations in the shape of substantially identical parallelograms having diagonal sides on alternate laminations crossing the diagonal sides of the adjacent laminations in the stack of said central leg;

each of said outer legs being connected to associated ones of said yokes with stacked laminations of said outer legs connected to associated laminations of said yokes by angle butt joints, said butt joints being step-lapped with the width of the steps being substantially equal, the laminations of each stack corresponding to each yoke having the shapes of non-right angle trapezoids and right angle trapezoids, the non-right angle trapezoid-shaped laminations alternating with the right angle trapezoid-shaped laminations, with the lengths of the bases of successively adjacent non-right angle trapezoid-shaped laminations being successively longer by twice said width of said steps and the lengths of the bases of successively adjacent right angle trapezoid-shaped laminations being successively longer by twice said width of said steps;

the non-right angle ends of said right angle trapezoid-shaped laminations of said yokes opposite said butt joints abutting longitudinal sides of the parallelogram-shaped laminations of said central leg; the ends of said non-right angle trapezoid-shaped laminations of said yokes opposite said butt joints abutting diagonal sides of the parallelogram-shaped laminations of said central leg;

said laminations of said outer legs being in the shapes of trapezoids, said laminations on said central leg, said outer legs and said yokes each having only four sides.

2. An iron core for a three-phase electromagnetic induction machine as claimed in claim 1 wherein said iron core is used with a three-phase transformer.

* * * * *